US007787802B2

(12) United States Patent
Yoshida

(10) Patent No.: US 7,787,802 B2
(45) Date of Patent: Aug. 31, 2010

(54) ATTACHING CONSTRUCTION FOR PRESSING ROLLER IN FIXING DEVICE

(75) Inventor: Takeshi Yoshida, Yao (JP)

(73) Assignee: Kyocera Mita Corporation, Osaka (JP)

( * ) Notice: Subject to any disclaimer, the term of this patent is extended or adjusted under 35 U.S.C. 154(b) by 174 days.

(21) Appl. No.: 11/728,724

(22) Filed: Mar. 27, 2007

(65) Prior Publication Data

US 2007/0286641 A1 Dec. 13, 2007

(30) Foreign Application Priority Data

Mar. 28, 2006 (JP) ..... 2006-088413
Feb. 22, 2007 (JP) ..... 2007-042510

(51) Int. Cl.
*G03G 15/20* (2006.01)

(52) U.S. Cl. ..... 399/122

(58) Field of Classification Search ..... 399/122, 399/328

See application file for complete search history.

(56) References Cited

U.S. PATENT DOCUMENTS 5,045,887 A * 9/1991 Nakamura ..... 399/122
5,253,013 A * 10/1993 Takano et al. ..... 399/130
5,826,141 A * 10/1998 Mitsuya ..... 399/122
7,330,682 B2 * 2/2008 Shinshi ..... 399/122
7,515,850 B2 * 4/2009 Hasegawa ..... 399/124
2003/0039492 A1 * 2/2003 Hamada et al. ..... 399/329
2008/0181645 A1 * 7/2008 Nakamura ..... 399/70

FOREIGN PATENT DOCUMENTS

JP 57076582 A * 5/1982
JP 60049375 A * 3/1985
JP 02153381 A * 6/1990

* cited by examiner

*Primary Examiner*—Quana M Grainger
(74) *Attorney, Agent, or Firm*—The Webb Law Firm

(57) ABSTRACT

In a fixing device of an image processing apparatus having the fixing roller for fixing a toner image on a paper sheet and the pressing roller which forms a nip for allowing passage of the paper sheet in cooperation with the fixing roller. The attaching construction for attaching the pressing roller under a pressed contact condition relative to the fixing roller includes a fixing roller support frame mounted to a machine frame of the fixing device and configured for rotatably supporting the fixing roller, a pressing roller support frame movable toward/away from the fixing roller support frame and configured for rotatably supporting the pressing roller, a fixing mechanism for fixing a reference position of the pressing roller support frame relative to the fixing roller support frame and an urging member for urging the pressing roller support frame toward the fixing roller support frame so as to bring the pressing roller into contact with the fixing roller.

6 Claims, 7 Drawing Sheets

(a)

(b)

ATTACHING CONSTRUCTION FOR PRESSING ROLLER IN FIXING DEVICE

CROSS-REFERENCE OF RELATED APPLICATION

The present application claims priorities based on JP 2006-88413 and JP 2007-42510 both assigned to this applicant and filed in Japan on Mar. 28, 2006 and Feb. 22, 2007, respectively, the entire disclosures thereof being incorporated herein as reference.

BACKGROUND OF THE INVENTION

1. Field of the Invention

The present invention relates to an attaching construction for attaching a pressing roller under a pressed contact condition relative to a fixing roller in a fixing device of an image processing apparatus having the fixing roller for fixing a toner image on a paper sheet and the pressing roller which forms a nip for allowing passage of the paper sheet in cooperation with the fixing roller.

2. Background Art

In a fixing device having a fixing roller and a pressing roller, the pressing roller needs to be attached along the length thereof with good precision relative to the fixing roller so that the pressing roller may be pressed against the fixing roller so as to form a substantially uniform contact width (nip width) with the fixing roller.

Conventionally, the attaching precision of the pressing roller would depend upon manufacturing precision of a pressing roller support member which rotatably supports opposed ends of this pressing roller, assembling precision of the pressing roller support member relative to a machine frame of the fixing device, assembling precision of the fixing roller relative to the machine frame of the fixing device, etc. (no particular document can be disclosed as this is a well-known or common technique in the art).

For this reason, high precisions would be required in the respective steps of manufacturing the pressing roller support member, assembling the pressing roller support member to the machine frame of the fixing device, assembling the fixing roller to the machine frame of the fixing device. Hence, it was difficult to reduce costs for the attachment of the pressing roller.

SUMMARY OF THE INVENTION

The present invention has been made in view of the above-described state of the art. For precision attachment of the pressing roller along the length thereof relative to the fixing roller so that the pressing roller may be pressed against the fixing roller so as to form a substantially uniform contact width (nip width) with the fixing roller, the object of the invention is to provide an improved attachment construction for the pressing roller in a fixing device, which construction allows reduction in the costs for the pressing roller attachment.

[First Characterizing Feature]

According to a first characterizing feature of an inventive attaching construction of a pressing roller under a pressed contact condition relative to a fixing roller in a fixing device of an image processing apparatus having the fixing roller for fixing a toner image on a paper sheet and the pressing roller which forms a nip for allowing passage of the paper sheet in cooperation with the fixing roller, the attaching construction comprises:

a fixing roller support frame mounted to a machine frame of the fixing device and configured for rotatably supporting the fixing roller;

a pressing roller support frame movable toward/away from said fixing roller support frame and configured for rotatably supporting the pressing roller;

a fixing mechanism for fixing a reference position of the pressing roller support frame relative to the fixing roller support frame; and an urging member for urging the pressing roller support frame toward the fixing roller support frame so as to bring the pressing roller into contact with the fixing roller.

[Function/Effect]

According to the pressing roller attaching construction described above, with the fixing mechanism, it is possible to reliably fix the reference position of the pressing roller support frame relative to the fixing roller support frame. Here, the language "reference position of the pressing roller support frame relative to the fixing roller support frame" refers to a position used as a reference when the pressing roller support frame is to be attached relative to the fixing roller support frame. For instance, this reference position can be a position where the pressing roller, with its own weight, comes into contact with the peripheral face of the fixing roller or a position where the pressing roller comes into slightly pressed contact with the fixing roller. Once this reference position has been fixed, the relative position between the fixing roller and the pressing roller will not change beyond the possible range of positional relationship between the fixing roller support frame and the pressing roller support frame. Consequently, the fixing roller and the pressing roller can cooperate to form a nip in a stable manner.

Next, with using the urging means from the reference position, the pressing roller support frame is urged toward the fixing roller support frame. In this case, there is not much need for considering the manufacturing precisions of the pressing roller support frame and the fixing roller support frame, the assembling precision of the pressing roller support frame relative to the fixing roller support frame, or the assembling precision of the fixing roller support frame relative to the machine frame of the fixing device. This is because irregularities in such precisions if any can be absorbed between the pressing roller and the fixing roller which are placed under the pressed contact condition by the urging means. Therefore, according to the present construction, it becomes possible to assemble the pressing roller relative to the fixing roller in an appropriate and easy manner. And, as much as there is no need for considering precision irregularities, the costs required for attachment of the pressing roller can be reduced, compared with the conventional art.

[Second Characterizing Feature]

According to a second characterizing feature of the present invention, there is provided a pivot shaft for pivoting said pressing roller support shaft about a pivot axis substantially parallel with a rotational axis of said pressing roller, and said urging member is provided between and across said pressing roller support frame and said fixing roller support frame.

[Function/Effect]

According to the pressing roller attaching construction described above, by pivoting the pressing roller support frame about the pivot axis, it is possible to move the pressing roller support frame toward/away from the fixing roller support frame. As such pivot shaft can be provided relatively easily and inexpensively, the costs for the pressing roller attachment can be reduced even further.

[Third Characterizing Feature]

According to a third characterizing feature of the invention, the attaching construction further comprises a position adjusting mechanism for adjusting a position of said pressing roller support frame relative to said fixing roller support frame.

[Function/Effect]

With the above-described pressing roller attaching construction, the position adjusting mechanism allows fine setting of the position of the pressing roller support frame relative to the fixing roller support frame (including the reference position described above in connection with the first characterizing feature). Therefore, by moving the pressing roller support frame to/away from the fixing roller support frame appropriately in accordance with the type, specifications, driving condition, etc. of the fixing device, the pressed contact condition between the pressing roller and the fixing roller can be adjusted appropriately, so that an appropriate nip can be easily formed between the fixing roller and the pressing roller.

[Fourth Characterizing Feature]

According to a fourth characterizing feature of the invention, said fixing roller support frame includes a guide groove for the movement of the pressing roller support frame toward/away from the fixing roller support frame.

[Function/Effect]

With the above-described pressing roller attaching construction, the easy and fine adjustment of the relative position between the fixing roller and the pressing roller can be realized simply by moving the pressing roller support frame along the guide groove provided in the fixing roller support frame. Therefore, by moving the pressing roller support frame to/away from the fixing roller support frame appropriately in accordance with the type, specifications, driving condition, etc. of the fixing device, the pressed contact condition between the pressing roller and the fixing roller can be adjusted appropriately, so that an appropriate nip can be easily formed between the fixing roller and the pressing roller.

[Fifth Characterizing Feature]

According to a fifth characterizing feature of the present invention, said pressing roller support frame supports the pressing roller at its opposed ends, independently.

[Function/Effect]

With the above-described pressing roller attaching construction, the pressing roller is supported independently, at its opposed ends, by the pressing roller support frame. Hence, even if a sheet, under an erroneously aligned condition, is introduced to the nip, the pressed contact condition of the pressing roller relative to the fixing roller can be appropriately maintained along the width of the pressing roller.

DESCRIPTION OF PREFERRED EMBODIMENTS

Next, preferred embodiments of the present invention will be described with reference to the accompanying drawings.

Figure 1:
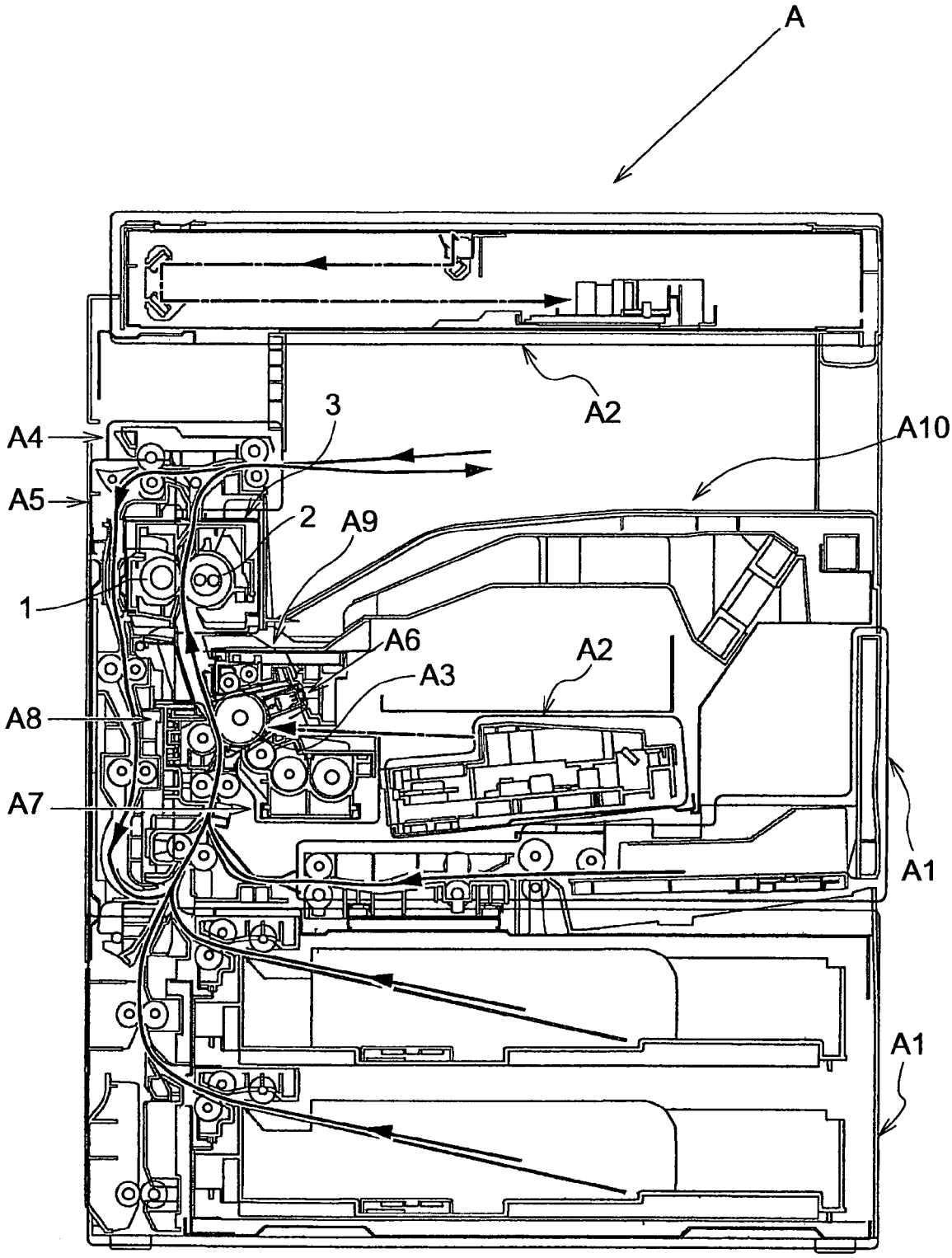
FIG. 1 is a schematic side view showing inside of a copier.

FIG. 1 shows a copier A as an example of an electronic photographic image forming apparatus. This copier A includes a fixing device 3 having a pressing roller 1 which is attached by an inventive pressing roller attaching construction.

The copier A includes a paper feeding section A1, an optical section A2, a photosensitive drum A3, the fixing device 3, a discharging/reversing section A4, a double face section A5, etc. Around the photosensitive drum A3, there are arranged such components as a main charger section A6, a developing section A7, a transferring/separating section A8, a cleaning/charge-removing section A9, etc. On the photosensitive drum A3, a toner image will be formed according to image information read at the optical section A2. This toner image is then transferred onto a paper sheet discharged from the paper feeding section A1 and fixed thereto by the fixing device 3 and then discharged into a discharged paper tray A10.

Figure 2:
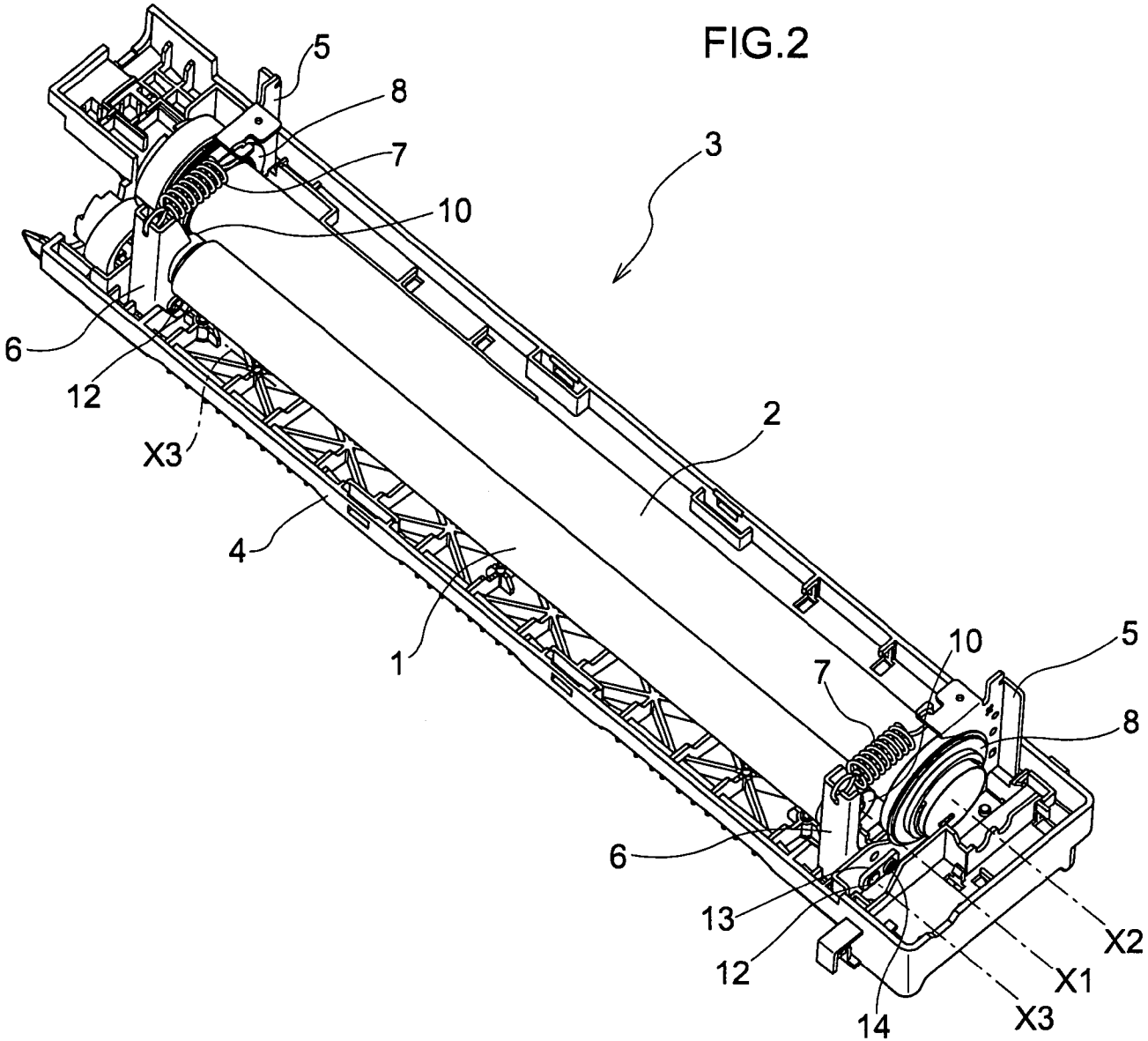
FIG. 2 is a perspective view of a fixing device.
Figure 3:
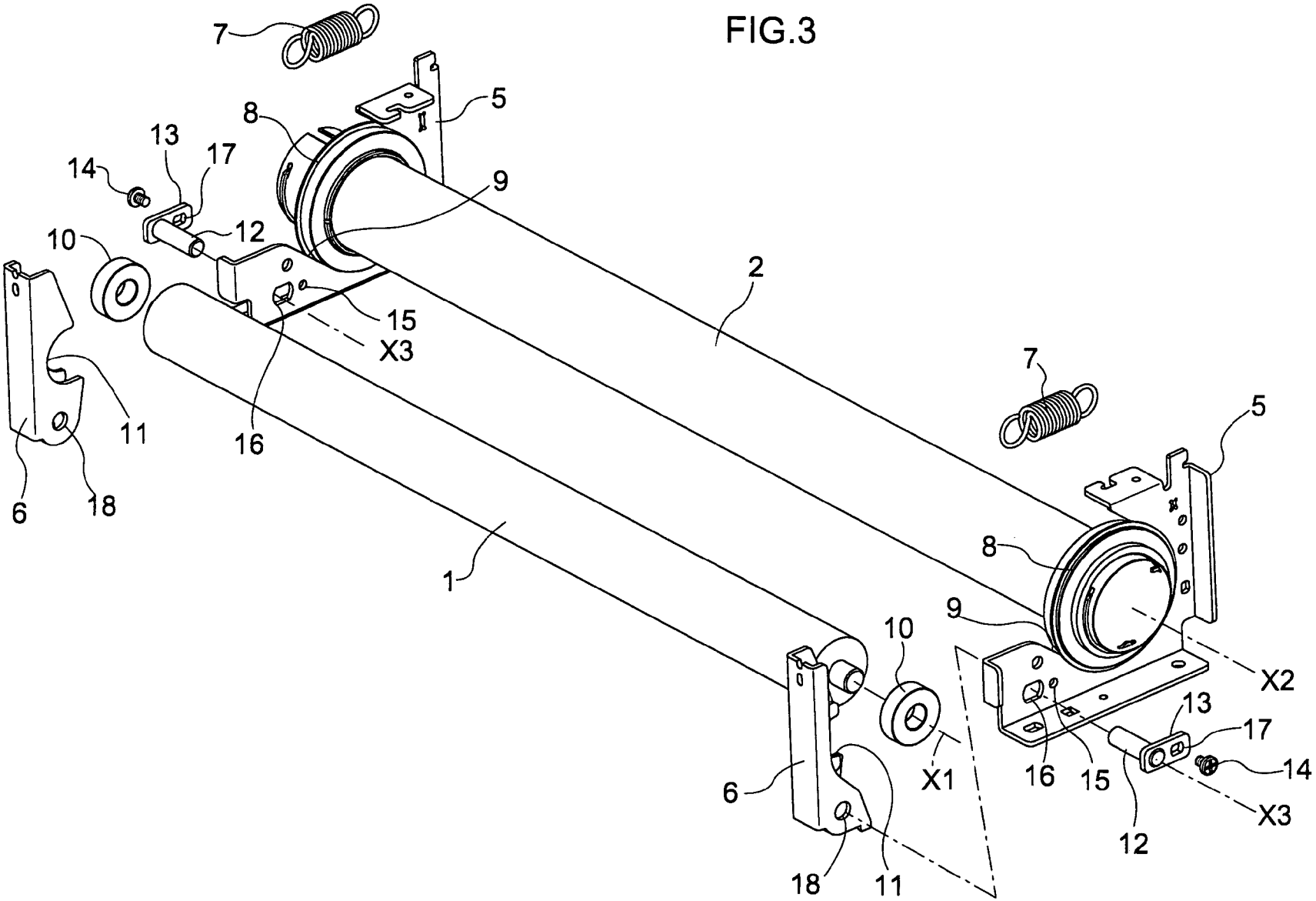
FIG. 3 is an exploded perspective view of the fixing device.

The fixing device 3, as shown in FIGS. 2 and 3, includes a heating-fixing roller 2 (to be referred simply as "fixing roller 2" hereinafter) and a pressing roller 1. The fixing roller 2 operates to fix the toner image onto a paper sheet. The pressing roller 1 and the fixing rollers 2 cooperate to form a nip allowing passage of a paper sheet therebetween. In the instant embodiment, the fixing roller 2 and the pressing roller 1 are elastically pressed and contacted with each other by means of pulling coil springs 7 which will be detailed later. The fixing roller 2 and the pressing roller 1 are assembled as an integral unit as being supported to a common machine frame 4 to be rotatable about respective rotational axes X1 and X2 which are substantially parallel with each other.

More particularly, opposed ends of the fixing roller 2 are fixed respectively to the machine frame 4 by means of a pair of fixing roller support frames 5 made of sheet metal and rotatably supporting this roller 2. Similarly, opposed ends of the pressing roller 1 are fixed respectively to the machine body 4 by means of a pair of pressing roller support frames 6 made of sheet metal and rotatably supporting this roller 1 to be independently pivotable about pivotal axes X3 which are substantially parallel with the rotational axis X1 of the pressing roller 1. Further, for the respective combinations of the right and left fixing roller support frames 5 and the right and left pressing roller support frames 6 opposed to each other across the pressing roller 1, the pulling coil springs 7 are provided as urging members or urging means for pulling the pressing roller support frame 6 toward the fixing roller support frame 5 of each combination. As shown in FIG. 2 or FIG. 3, the pulling coil spring 7 is mounted between and across the pressing roller support frame 6 and the fixing roller support frame 5. This arrangement ensures reliable pressed contact of the pressing roller 1 relative to the fixing roller 2.

As an alternative urging member, a pulling coil spring for urging the pressing roller support frame 6 toward the fixing roller support frame 5 may be provided between and across the machine frame 4 and the pressing roller support frame 6. In this case too, the pressing roller 1 can be pressed and contacted against the fixing roller 2.

On opposed ends of the fixing roller 2, there are attached ring-shaped bearing members 8. The outer peripheral portion of each ring-shaped bearing member 8 is fitted within a semi-circular arcuate recess 9 defined in the associated fixing roller support frame 5. With this, the fixing roller 2 is supported to the fixing roller support frames 5 to be rotatable about the rotational axis X2.

Similarly, on opposed ends of the pressing roller 1, there are attached ring-shaped bearing members 10. The outer peripheral portion of each ring-shaped bearing member 10 is fitted within a semi-circular arcuate recess 11 defined in the associated pressing roller support frame 6. With this, the pressing roller 1 is supported to the pressing roller support frames 6 to be rotatable about the rotational axis X1.

From opposed sides of the pair of pressing roller support frames 6, there are inserted pivot shafts 12 for pivoting the pressing roller support frame 6 about the pivotal axis X3 extending substantially parallel with the rotational axis X1 of the pressing roller 1. The opposed pivot shafts 12 are fixed to a pair of intermediate plate members 13, which in turn are fastened by screws 14 to the side of machine frame 4, namely, to the opposed fixing roller support frames 5. With this, the pressing roller 1 is pivotally supported to the machine frame 4 side via the intermediate plate members 13, independently at its opposed ends. With such independent supporting arrangement, e.g. even if a paper sheet, under an erroneously aligned posture, is introduced to the nip, the pressed contact condition of the pressing roller 1 relative to the fixing roller 2 can be appropriately maintained along the width of the pressing roller 1.

Next, a method of assembling the inventive attaching construction for the pressing roller 1 will be explained with reference to FIGS. 3 through 6.

As shown in FIG. 3, each fixing roller support frame 5 defines a female screw hole 15 for threading engagement with the screw 14 and a pivot shaft inserting slot 16 which is elongate substantially along the direction of pressed contact of the pressing roller 1 relative to the fixing roller 2. Each intermediate plate member 13 defines a screw inserting slot 17 which is elongate substantially along the direction of pressed contact of the pressing roller 1 relative to the fixing roller 2.

Figure 4:
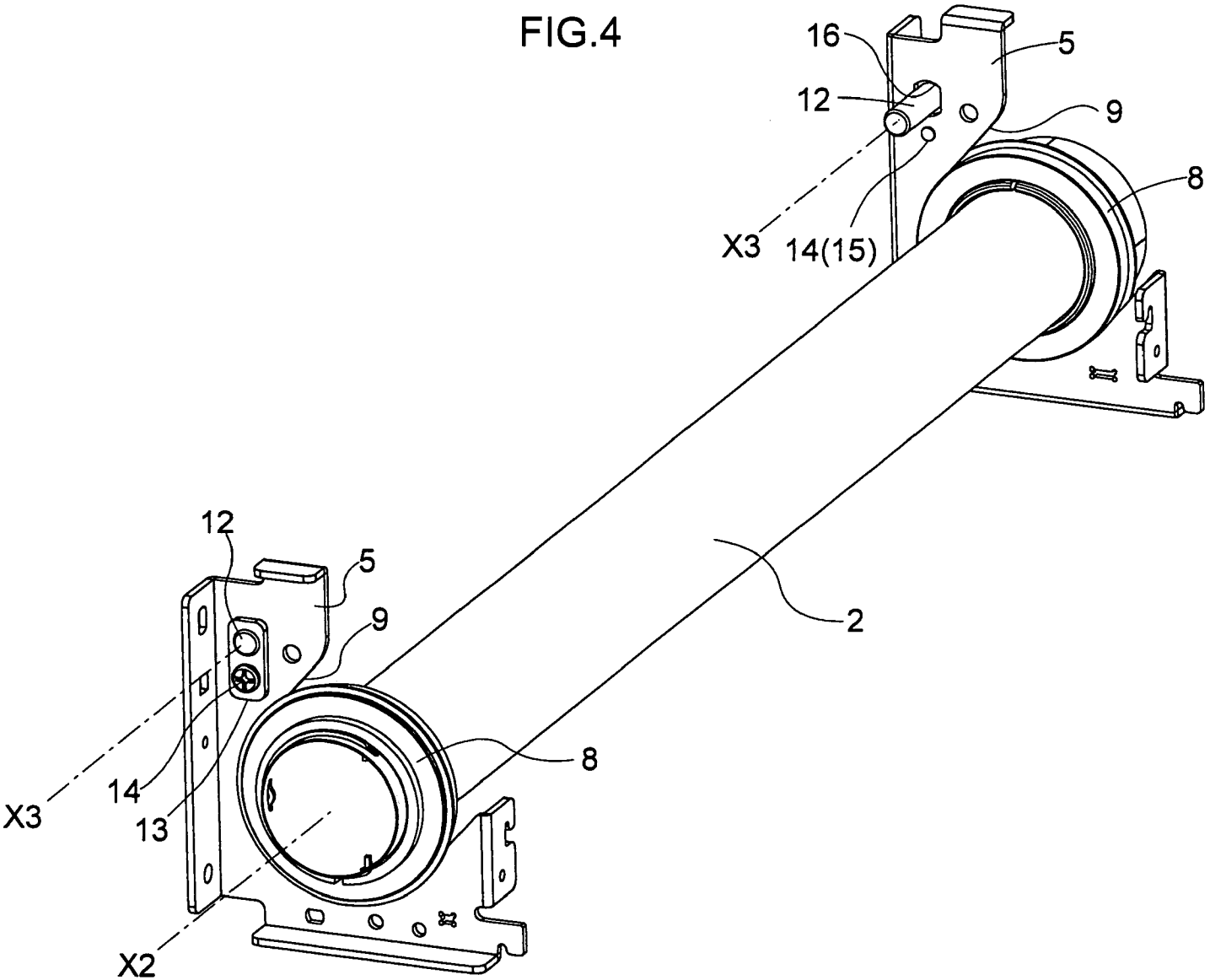
FIG. 4 is an explanatory perspective view of a pressing roller attaching construction.

First, as illustrated in FIG. 4, the posture of the fixing roller support frame 5 will be determined such that the intermediate plate member 13 may be located upwardly of the fixing roller 2. In this, with keeping the pivot shaft 12 inserted in the pivot shaft inserting slot 16, the screw 14 inserted in the screw inserting slot 17, will be fastened into the female screw hole 15. With this, the intermediate plate member 13 will be temporarily or loosely fixed to the associated fixing roller support frame 5.

Figure 5:
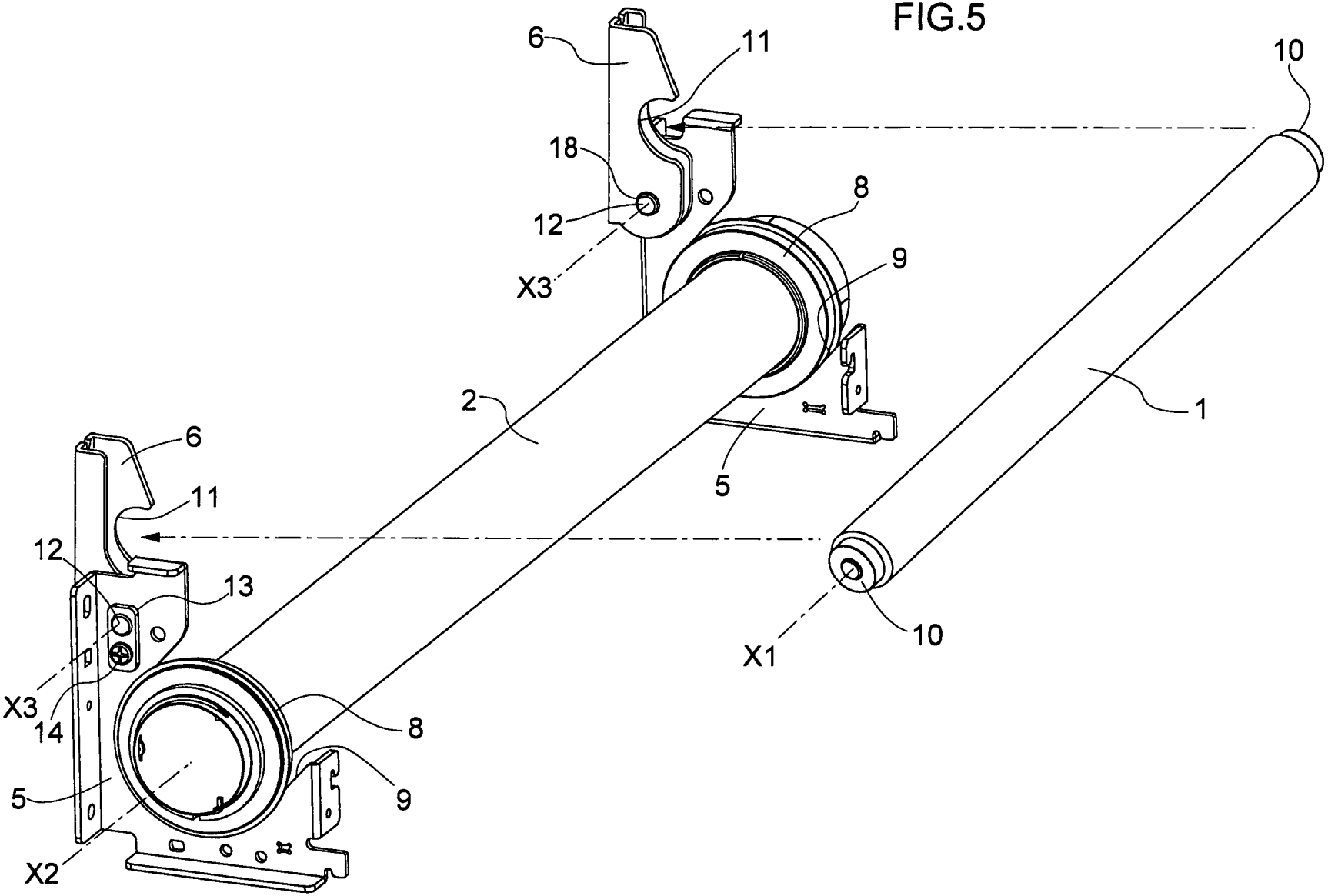
FIG. 5 is an explanatory perspective view of the pressing roller attaching construction.

Next, as illustrated in FIG. 5, the pivot shaft 12 will be inserted to a shaft hole 18 defined in the pressing roller support frame 6, thus assembling the pressing roller support frame 6. Further, the outer peripheral portions of the bearing members 10 will be fitted within the arcuate recesses 11 of the respective press roller support frames 6, thus assembling the pressing roller 1.

Figure 6:
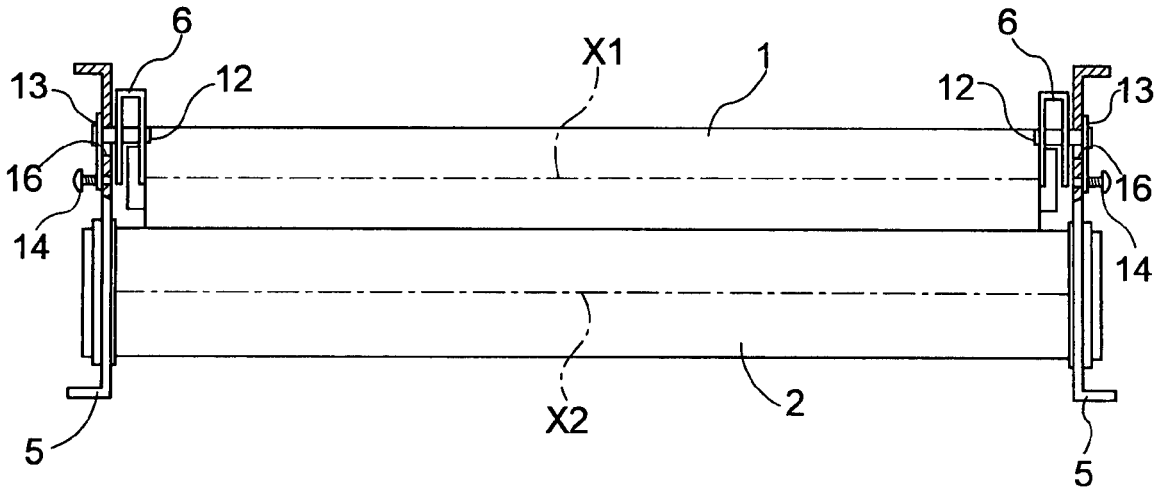
FIG. 6 is an explanatory plan view of the pressing roller attaching construction.
Figure 6:
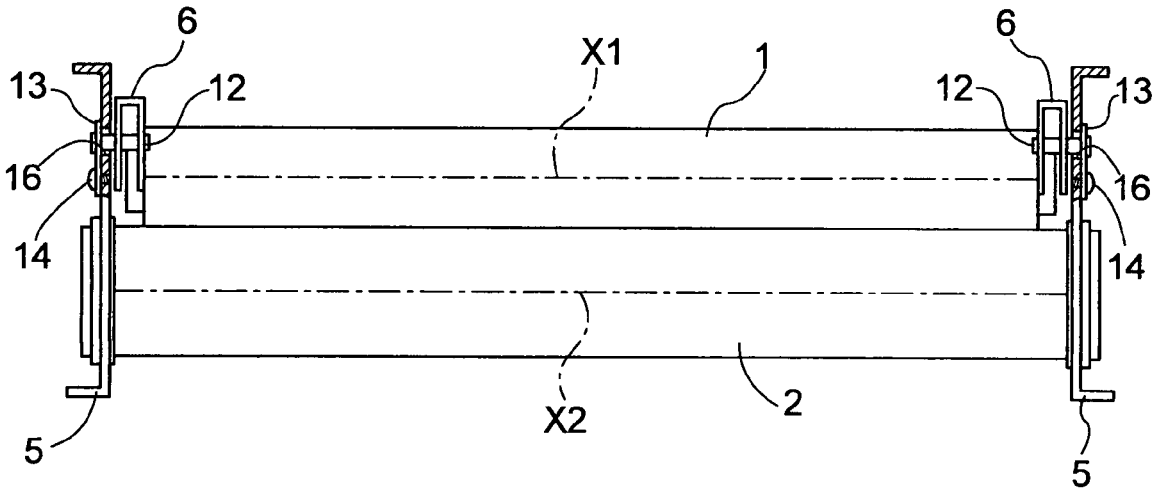
Figure 7:
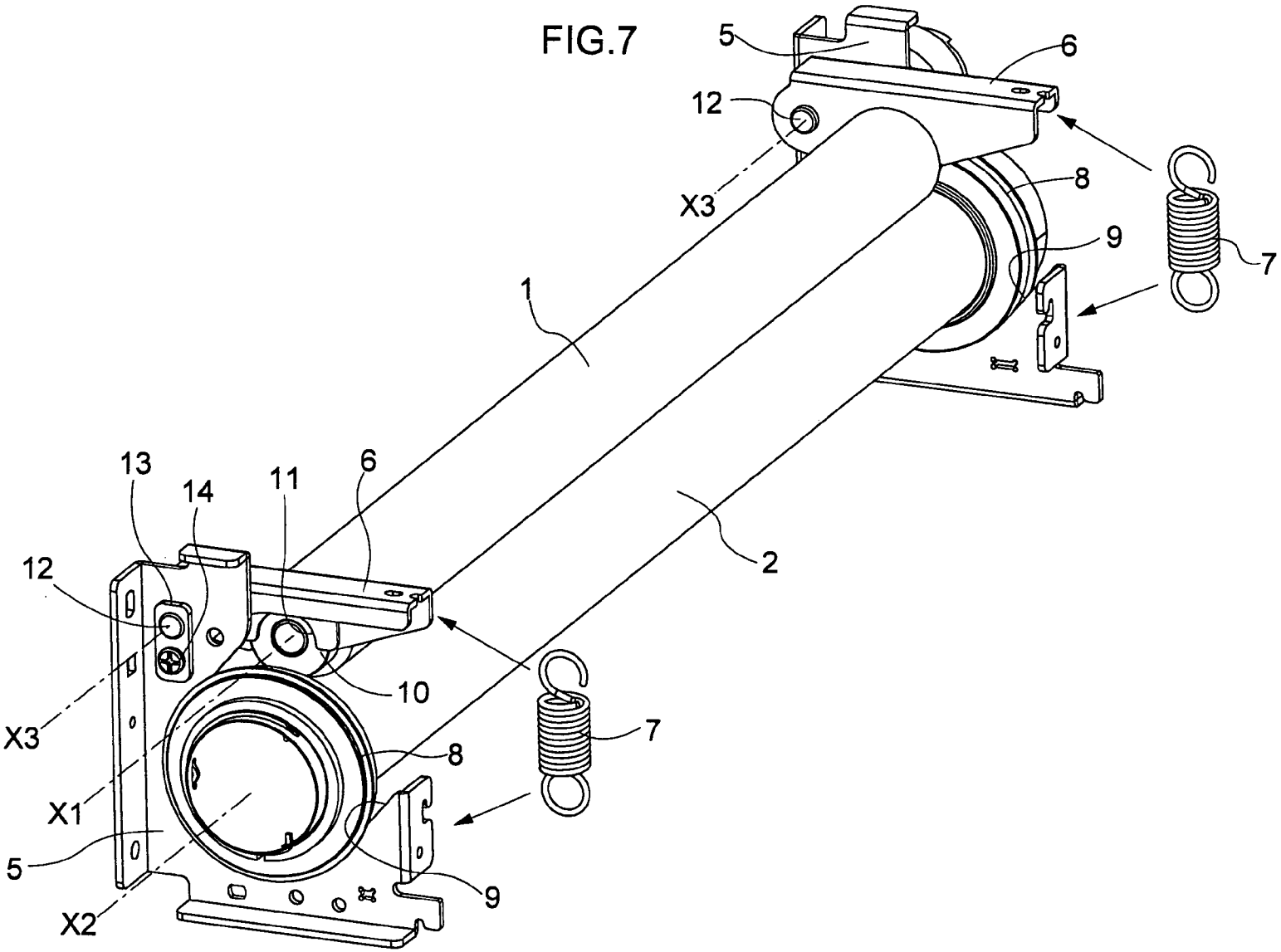
FIG. 7 is an explanatory perspective view of the pressing roller attaching construction.

Next, as illustrated in FIG. 6(*a*), the screws 14 will be loosened so as to place the outer peripheral face of the pressing roller 1, due to its own weight and along the entire length thereof, into pressed contact with the peripheral face of the fixing roller 2. And, each intermediate plate member 13 with the pivot shaft 12 being inserted to the pivot shaft inserting slot 16 thereof and also the screw 14 being inserted to the screw inserting slot 17 thereof, will be moved along the pressing contact direction, thus fixing the pivot shaft 12 fixed to each intermediate plate member 13 in position. Under this position-fixed condition, as illustrated in FIG. 6(*b*) and FIG. 7, the screw 14 will be tightly threaded into the female screw hole 15, thus fixing each intermediate plate member 13 integrally to the fixing roller support frame 5. In this way, in the instant embodiment, the screw 14 and the female screw hole 15 together constitute "a fixing mechanism" and the above-described fixed position represents "a reference position". At this reference position, the relative position between the fixing roller 2 and the pressing roller 1 will not change beyond the possible range of positional relationship between the fixing roller support frame 5 and the pressing roller support frame 6. Therefore, it is possible for the fixing roller 2 and the pressing roller 1 to cooperate to form a stable nip therebetween.

Incidentally, the above-described screw inserting slot 17 functions also as "a position adjusting mechanism" for adjusting the position of the pressing roller support frame 6 relative to the fixing roller support frame 5. That is, the position of the screw inserting slot 17 to which the screw 14 is to be inserted can be changed. This allows fine setting of the position (including the above-described reference position) of the pressing roller support frame 6 relative to the fixing roller support frame 5. Therefore, by moving the pressing roller support frame 6 closer to/away from the fixing roller support frame 5 appropriately in accordance with the type, specifications, driving condition, etc. of the fixing device, the pressed contact condition between the pressing roller 1 and the fixing roller 2 can be adjusted appropriately, so that an appropriate nip can be easily formed between the fixing roller 2 and the pressing roller 1.

Next, by using the urging means from the reference position, the pressing roller support frame 6 will be urged toward the fixing roller support frame 5. More particularly, the pulling coil springs 7 will be attached between and across the pressing roller support frames 6 and the fixing roller support frames 5, so as to place the fixing roller 2 and the pressing roller 1 into the mutually and elastically pressed contact condition, as shown in FIG. 2. In this, there is not much need for considering the manufacturing precisions of the pressing roller support frame 6 and the fixing roller support frame 5, the assembling precision of the pressing roller support frame 6 relative to the fixing roller support frame 5, or the assembling precision of the fixing roller support frame 5 relative to the machine frame 4 of the fixing device. This is because irregularities in such precisions can be absorbed between the pressing roller 1 and the fixing roller 2 which are placed under the pressed contact condition by the pulling coil springs 7. Therefore, according to the present embodiment, it becomes possible to assemble the pressing roller 1 relative to the fixing roller 2 in an appropriate and easy manner. And, as much as there is no need for considering precision irregularities, the costs required for attachment of the pressing roller 1 can be reduced, compared with the conventional art.

Further, the construction in this embodiment that the pivot shaft 12 allows movement of the pressing roller support frame 6 to/away from the fixing roller support frame 5 can be obtained relatively easily and inexpensively.

Other Embodiments

1. In the inventive pressing roller attaching construction, instead of the pivot shaft 12 described above, the fixing roller support frame 5 may include a guide groove (not shown) for allowing the movement of the pressing roller support frame 6 to/away from the fixing roller support frame 5. In this case, the easy and fine adjustment of the relative position between the fixing roller 2 and the pressing roller 1 can be realized simply by moving the pressing roller support frame 6 along the guide groove provided in the fixing roller support frame 5.

Therefore, by moving the pressing roller support frame 6 relative to the fixing roller support frame 5 appropriately in accordance with the type, specifications, driving condition, etc. of the fixing device, the pressed contact condition between the pressing roller 1 and the fixing roller 2 can be adjusted appropriately, so that an appropriate nip can be easily formed between the fixing roller 2 and the pressing roller 1.

2. In the inventive pressing roller attaching construction, the intermediate plate member 13 can be directly fixed to the machine frame 4 by means of a screw. This construction can provide increase in the attachment strength of the intermediate plate member 13 and improved durability.

3. In the inventive pressing roller attaching construction, the pair of fixing roller support frames 5 may be fixed integrally to the machine frame 4 side so as to rotatably support the opposed ends of the fixing roller 2. This construction increases the rigidity of the fixing roller support frame 5 and improves its durability.

4. The inventive pressing roller attaching construction can be directly incorporated in the apparatus frame of the electronic photographic image forming apparatus. In this case, the machine frame of the fixing device can be omitted at all or at least simplified, so that the manufacture costs can be even further reduced.

5. The inventive pressing roller attaching construction can be applied to a variety of image processing apparatuses such as a printer, a copier, a facsimile, etc.

The invention claimed is:

1. An attaching construction of a pressing roller under a pressed contact condition relative to a fixing roller in a fixing device of an image processing apparatus having the fixing roller for fixing a toner image on a paper sheet and the pressing roller which forms a nip for allowing passage of the paper sheet in cooperation with the fixing roller, the attaching construction comprising:

a fixing roller support frame mounted to a machine frame of the fixing device and configured for rotatably supporting the fixing roller;

a pressing roller support frame movable toward/away from said fixing roller support frame and configured for rotatably supporting the pressing roller;

a pivot shaft for pivoting said pressing roller support frame about a pivot axis substantially parallel with a rotational axis of said pressing roller;

a position adjusting mechanism having a pivot shaft inserting slot formed in the fixing roller support frame to extend along a direction of pressed contact of the pressing roller relative to the fixing roller for adjusting a position of said pressing roller support frame relative to said fixing roller support frame by allowing the pivot shaft to move along the direction of pressed contact of the pressing roller relative to the fixing roller within the pivot shaft inserting slot;

a fixing mechanism for fixing a reference position of the pressing roller support frame after the position of the pressing roller support frame relative to the fixing roller support frame is adjusted by the position adjusting mechanism; and an urging member coupled to the fixing roller support frame and the pressing roller support frame, the urging member for urging the pressing roller support frame toward the fixing roller support frame so as to bring the pressing roller into contact with the fixing roller.

2. The pressing roller attaching construction according to claim 1, wherein said fixing roller support frame includes a guide groove for the movement of the pressing roller support frame toward/away from the fixing roller support frame.

3. The pressing roller attaching construction according to claim 1, wherein said pressing roller support frame supports the pressing roller at its opposed ends, independently.

4. An attaching construction of a pressing roller under a pressed contact condition relative to a fixing roller in a fixing device of an image processing apparatus having the fixing roller for fixing a toner image on a paper sheet and the pressing roller which forms a nip for allowing passage of the paper sheet in cooperation with the fixing roller, the attaching construction comprising:

a fixing roller support frame mounted to a machine frame of the fixing device and configured for rotatably supporting the fixing roller;

a pressing roller support frame movable toward/away from said fixing roller support frame and configured for rotatably supporting the pressing roller;

a pivot shaft for pivoting said pressing roller support frame about a pivot axis substantially parallel with a rotational axis of said pressing roller;

a position adjusting mechanism having a pivot shaft inserting slot formed in the fixing roller support frame to extend along a direction of pressed contact of the pressing roller relative to the fixing roller for adjusting a position of said pressing roller support frame relative to said fixing roller support frame by allowing the pivot shaft to move along the direction of pressed contact of the pressing roller relative to the fixing roller within the pivot shaft inserting slot;

a fixing mechanism for fixing a reference position of the pressing roller support frame through a screw after the position of the pressing roller support frame relative to the fixing roller support frame is adjusted by the position adjusting mechanism; and an urging member coupled to the fixing roller support frame and the pressing roller support frame, the urging member for urging the pressing roller support frame toward the fixing roller support frame so as to bring the pressing roller into contact with the fixing roller.

5. The pressing roller attaching construction according to claim 4, wherein said fixing roller support frame includes a guide groove for the movement of the pressing roller support frame toward/away from the fixing roller support frame.

6. The pressing roller attaching construction according to claim 4, wherein said pressing roller support frame supports the pressing roller at its opposed ends, independently.

* * * * *